US005312308A

United States Patent [19]

Hamilton et al.

[11] Patent Number: 5,312,308

[45] Date of Patent: May 17, 1994

[54] FOREARM EXERCISE APPARATUS

[76] Inventors: James H. Hamilton, 4264 Sunnyslope Rd. SW., Port Orchard, Wash. 98366; Barbara J. Butt, 5258 Ethel St., Brighton, Mich. 48116

[21] Appl. No.: 69,754

[22] Filed: Jun. 1, 1993

[51] Int. Cl.[5] ..... A63B 21/00

[52] U.S. Cl. ..... 482/44; 482/108; 273/193 A

[58] Field of Search ..... 482/21, 22, 49, 50, 482/108, 107, 106, 109, 148; 273/193 A

[56] References Cited

U.S. PATENT DOCUMENTS

| | | | |
|---|---|---|---|
| 675,314 | 5/1901 | Abenheim | 482/108 |
| 850,964 | 4/1907 | Pelletier et al. | 482/108 |
| 1,631,388 | 6/1927 | Weschke | 482/109 |
| 1,658,108 | 2/1928 | Vaughn | 482/109 |
| 3,874,660 | 4/1975 | Brether | 482/109 |
| 4,021,040 | 5/1977 | Inoue | 482/107 |
| 4,819,935 | 4/1989 | Dirksing | 482/108 |
| 5,121,925 | 6/1992 | Blundo | 273/193 A |

FOREIGN PATENT DOCUMENTS

| | | | |
|---|---|---|---|
| 0026751 | of 1898 | United Kingdom | 482/108 |
| 0003696 | of 1900 | United Kingdom | 482/106 |

OTHER PUBLICATIONS

SWINGRITE Nov. 1976 Golf Magazine p. 117.

*Primary Examiner*—Richard J. Apley
*Assistant Examiner*—Jerome Donnelly
*Attorney, Agent, or Firm*—E. Michael Combs

[57] ABSTRACT

An apparatus including an elongate handle, having a shaft coaxially aligned therewith, including positioning structure such as an "O" ring to maintain a plurality of weighted rings in adjacency to a remote end of the shaft in abutment with a head cap. A modification of the invention includes a plurality of shafts mounted to the head cap, each including further ring structure to provide for adjustable resistance in use of the organization.

2 Claims, 4 Drawing Sheets

FOREARM EXERCISE APPARATUS

BACKGROUND OF THE INVENTION

1. Field of the Invention

The field of invention relates to exercise apparatus, and more particularly pertains to a new and improved forearm exercise apparatus wherein the same is arranged as a compact, readily adjustable organization.

2. Description of the Prior Art

Various exercise apparatus has been employed in the prior art, wherein U.S. Pat. No. 4,258,913 to Brentham sets forth a forearm exercise structure including a support frame having various manipulated handle members secured thereto. U.S. Pat. No. 4,840,370 sets forth a hand exercise apparatus forming a block of material for grasping by the palm of the hand, wherein U.S. Pat. No. 4,901,999 sets forth a hand, wrist, and forearm resistance structure employing a plurality of spherical balls attached to ends of a cylindrical ball mounting grip handles.

The instant invention attempts to overcome deficiencies of the prior art by providing for a forearm exercise apparatus arranged to focus and concentrate on the exercise of forearm muscles of an individual's arm and in this respect, the present invention substantially fulfills this need.

SUMMARY OF THE INVENTION

In view of the foregoing disadvantages inherent in the known types of exercise apparatus now present in the prior art, the present invention provides a forearm exercise apparatus wherein the same is directed to the mounting in an adjustable relationship of weighted plates relative to a distal end portion of a shaft structure. As such, the general purpose of the present invention, which will be described subsequently in greater detail, is to provide a new and improved forearm exercise apparatus which has all the advantages of the prior art forearm exercise apparatus and none of the disadvantages.

To attain this, the present invention provides an apparatus including an elongate handle, having a shaft coaxially aligned therewith, including positioning structure such as an "O" ring to maintain a plurality of weighted rings in adjacency to a remote end of the shaft in abutment with a head cap. A modification of the invention includes a plurality of shafts mounted to the head cap, each including further ring structure to provide for adjustable resistance in use of the organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved forearm exercise apparatus which has all the advantages of the prior art forearm exercise apparatus and none of the disadvantages.

It is another object of the present invention to provide a new and improved forearm exercise apparatus which may be easily and efficiently manufactured and marketed.

It is a further object of the present invention to provide a new and improved forearm exercise apparatus which is of a durable and reliable construction.

An even further object of the present invention is to provide a new and improved forearm exercise apparatus which is susceptible of a low cost of manufacture with regard to both materials and labor, and which accordingly is then susceptible of low prices of sale to the consuming public, thereby making such forearm exercise apparatus economically available to the buying public.

Still yet another object of the present invention is to provide a new and improved forearm exercise apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
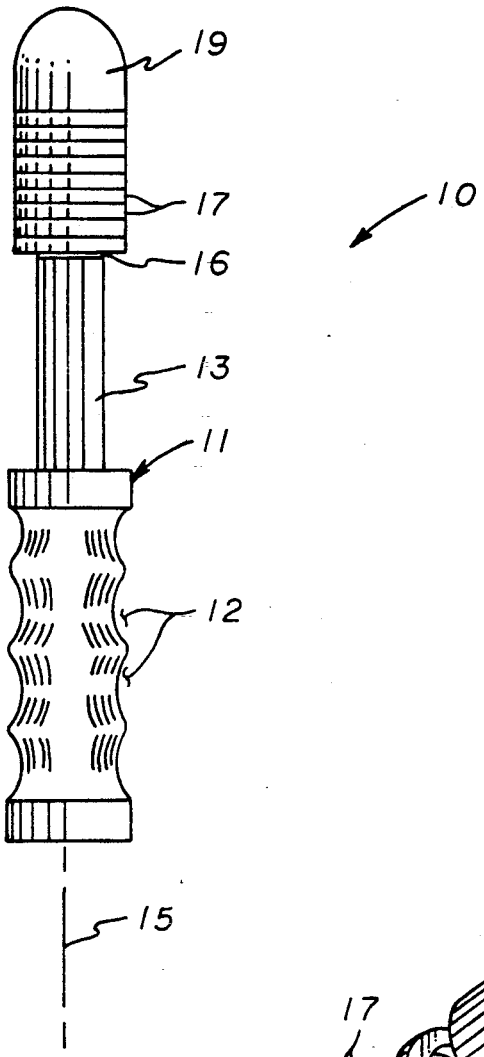
FIG. 1 is an orthographic view of the invention.
Figure 2:
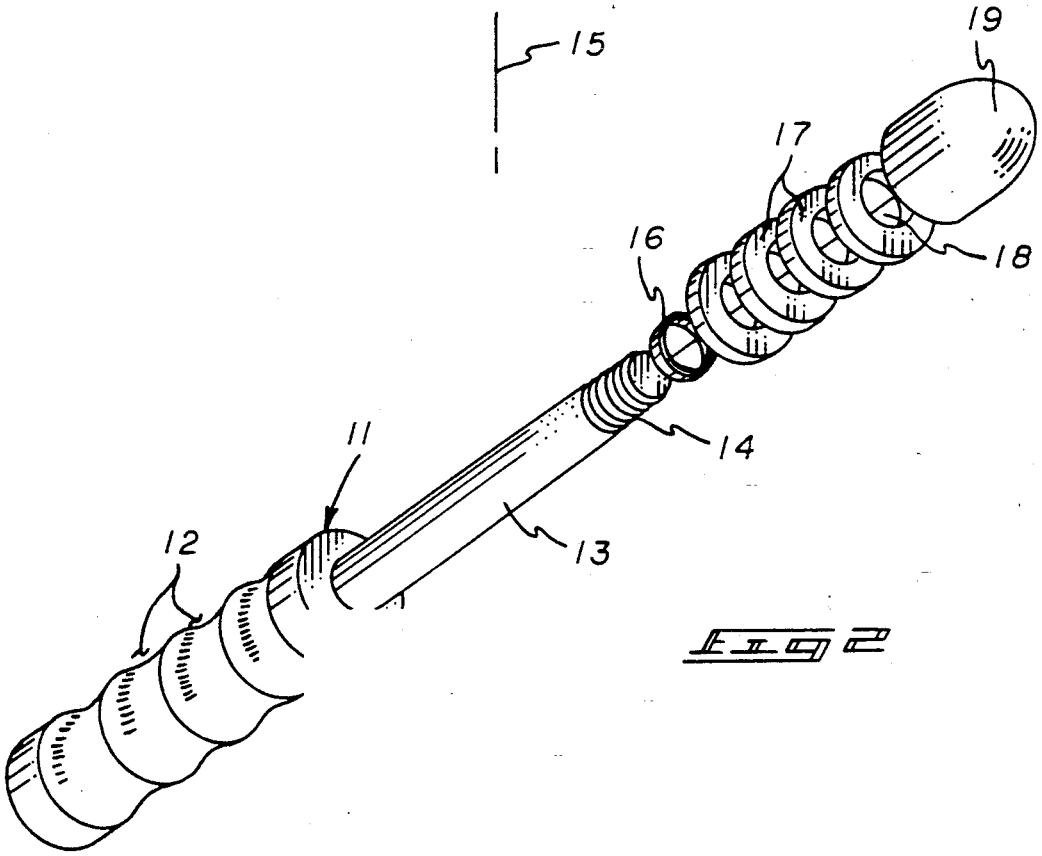
FIG. 2 is an isometric illustration of the invention.

With reference now to the drawings, and in particular to FIGS. 1 to 8 thereof, a new and improved forearm exercise apparatus embodying the principles and concepts of the present invention and generally designated by the reference numerals 10 and 10*a* will be described.

More specifically, the forearm exercise apparatus 10 of the instant invention essentially comprises an elongate handle 11 coaxially aligned about an axis 15, with the handle 11 including spaced finger recesses 12 directed therealong for enhance manual grasping of the handle 11. A rigid shaft 13 extends coaxially aligned relative to the handle 11 extending from a first end thereof. An "O" ring 16 is provided arranged for frictional engagement about the shaft spaced from the shaft externally threaded free end 14. A plurality of weight rings 17 is provided for selective positioning between the "O" ring 16 and the externally threaded free end 14 that in turn receives a head cap 19. When the weight rings 17, each having a central bore 18, are directed about the shaft 13, the head cap 19 is directed onto an externally threaded free end 14 and received within the internally threaded socket 20 of the head cap 19. In addition to the "O" ring, a coil spring member 21 is provided arranged between the handle first end and the weight ring 17 to bias the weight rings towards the head cap 19 to thereby space the weight rings at the greatest distance relative to the handle 11. The coil spring member 21 permits the weight ring 17 to deflect somewhat against the spring 21 to accommodate impact as the handle 11 is grasped and manipulated about the full range of motion that an individual's wrist permits to thereby impart muscular toning to an individual's forearm.

Figure 5:
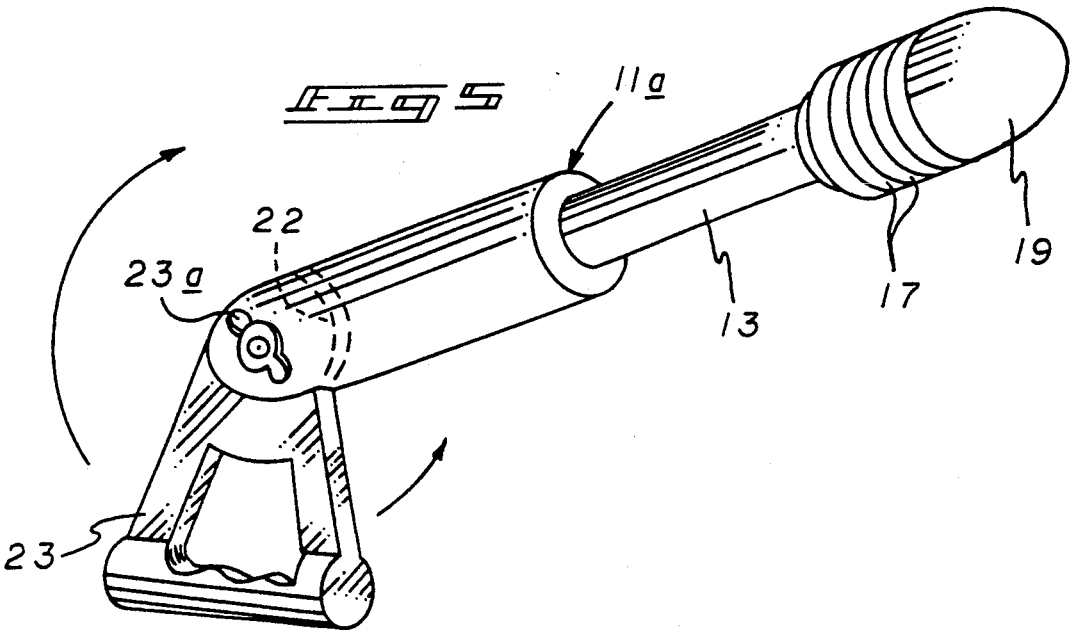
FIG. 5 is an isometric illustration of the invention employing a modified handle structure.

The FIG. 5 includes a modified handle 11*a*, including a handle slot 22 that in turn receives a handle plate member 23 within the slot and secured therein by a handle plate member fastener 23*a* directed through the handle plate and within the handle slot 22 to secure the handle plate within the slot 22.

Figure 6:
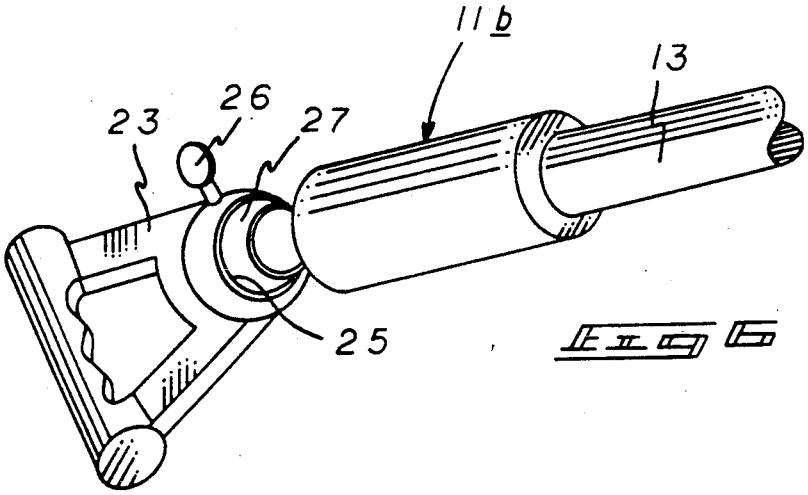
FIG. 6 is an isometric illustration of a further modified handle structure for use by the invention.
Figure 7:
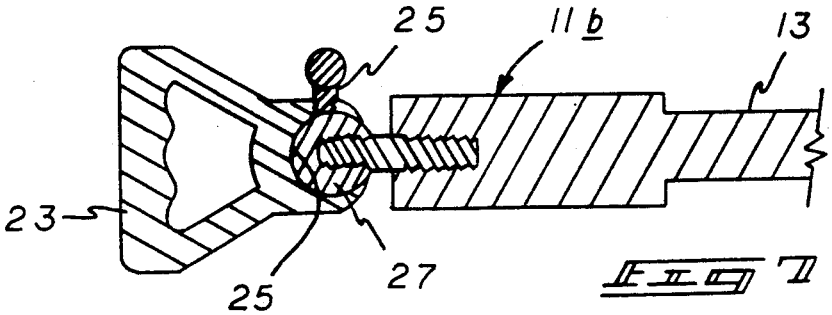
FIG. 7 is an orthographic cross-sectional view of the further modified handle structure, as indicated in FIG. 6.

The FIG. 6 indicates the use of the handle plate member 23 arranged to include a handle plate socket 25 that secures a pivot sphere 27 within. The pivot sphere is fixedly mounted in adjacency to the handle 11*b* second end spaced from the first end and the shaft 13. A fastener 26 is threadedly directed through the socket 25 to engage the sphere 27 to permit orientation of the handle 23 as desired to thereby permit changing of the leveraging of the weights 17 as they are manipulated by an individual's hand in use.

Figure 3:
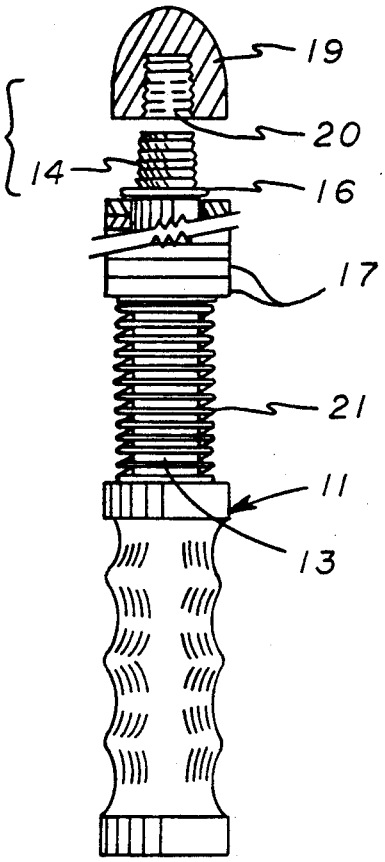
FIG. 3 is an orthographic cross-sectional illustration of the end cap structure arranged for mounting to the shaft structure.
Figure 4:
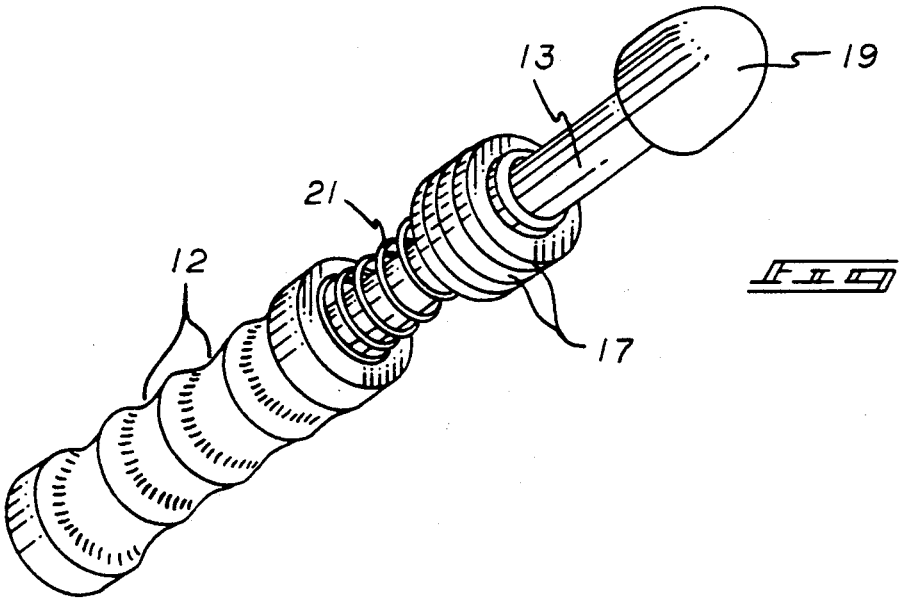
FIG. 4 is an isometric illustration of the invention, as indicated in FIG. 3.
Figure 8:
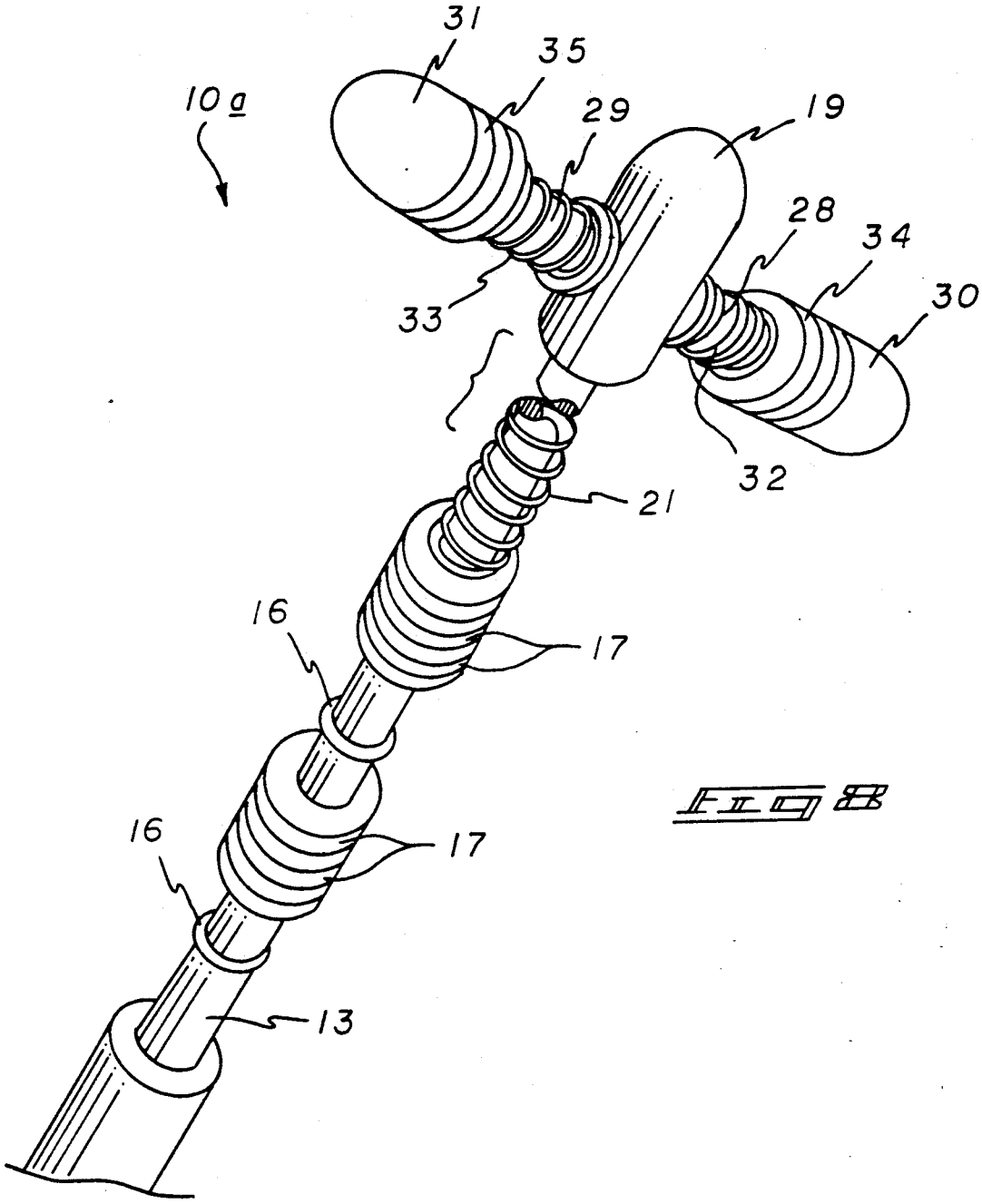
FIG. 8 is an isometric illustration of a modified aspect of the invention.

The FIG. 8 further includes respective first and second accessory shafts 28 and 29 that are coaxially aligned and orthogonally oriented relative to the rigid shaft 13. The first and second shafts each include respective first and second shaft springs 32 and 33 arranged to abut first and second shaft weighted discs 34 and 35 against the respective first and second shaft heads 30 and 31 that are threadedly mounted to the respective first and second accessory shafts 28 and 29, in a manner as indicated in FIG. 3, utilizing a threaded interconnection. The elongate rigid shaft 13 may employ a plurality of sets of weighted members 17, with one of the weighted sets oriented between spaced "O" rings. The spring member 21 may be positioned between the head cap 19 and one of the sets of weight rings 17, as illustrated.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A forearm exercise apparatus, comprising, an elongate handle having a handle first end spaced from a handle second end, with the handle symmetrically oriented about a predetermined axis, with a rigid shaft fixedly mounted to the first end concentrically oriented relative to the axis, the rigid shaft having a rigid shaft externally threaded free end, and a head cap, the head cap including an internally threaded socket arranged for mounting upon the free end, and at least one weight ring having a central bore receiving the rigid shaft therethrough between the handle first end and the head cap, and positioning means oriented between the weight ring and the handle first end to orient the at least one weight ring in adjacency to the head cap, and a coil spring member extending between the at least one weight ring and the handle first end, and the handle second end includes a pivot sphere and a handle plate, the handle plate having a handle plate socket receiving the pivot sphere therewithin, and a fastener directed into the socket in engagement with the pivot sphere to permit orientation of the handle plate relative to the pivot sphere.

2. An apparatus as set forth in claim 1 wherein the head cap includes a first shaft and a second shaft positioned on opposed sides of the head cap, wherein the first shaft and the second shaft are coaxially aligned and are orthogonally oriented relative to the rigid shaft, with the first shaft having a first shaft head removably mounted relative to the first shaft, and the second shaft having a second shaft head removably mounted relative to the second shaft, with at least one first shaft weight disc positioned on the first shaft in adjacency relative to the first shaft head, and at least one second shaft weight disc mounted upon the second shaft in adjacency to the second shaft head, with a first shaft spring interposed between the first shaft weight disc and the head cap, and a second shaft spring interposed between the head cap and the second shaft weight disc.

* * * * *